US007399213B2

(12) United States Patent
Webb

(10) Patent No.: US 7,399,213 B2
(45) Date of Patent: Jul. 15, 2008

(54) ROWING OR SCULLING OAR HANDLE

(76) Inventor: Emily Webb, Brecon House, De Clere Way, Trellech, Monmouthshire, South Wales (GB) NP25 4NY ( * ) Notice: Subject to any disclaimer, the term of this patent is extended or adjusted under 35 U.S.C. 154(b) by 0 days.

(21) Appl. No.: 11/429,352

(22) Filed: May 5, 2006

(65) Prior Publication Data

US 2006/0286878 A1 Dec. 21, 2006

(30) Foreign Application Priority Data

May 5, 2005 (GB) ..... 0509194.7

(51) Int. Cl.
*B63H 16/04* (2006.01)

(52) U.S. Cl. ..... 440/101

(58) Field of Classification Search ..... 440/101
See application file for complete search history.

(56) References Cited

U.S. PATENT DOCUMENTS 5,820,424 A * 10/1998 Steinhour et al. ..... 440/101
6,419,601 B1 * 7/2002 Kenner ..... 473/552

FOREIGN PATENT DOCUMENTS

GB 348995 5/1931
GB 1308605 2/1973

* cited by examiner

*Primary Examiner*—Jesús D Sotelo
(74) *Attorney, Agent, or Firm*—Lerner, David, Littenberg, Krumholz & Mentlik, LLP

(57) ABSTRACT

A rowing or sculling oar handle in which when the handle is orientated for a stroke it has an axial cross-sectional shape with a greater horizontal extent than vertical extent, and in which an underside of the axial cross-sectional shape is provided with an abutment.

16 Claims, 1 Drawing Sheet

Figure 1:
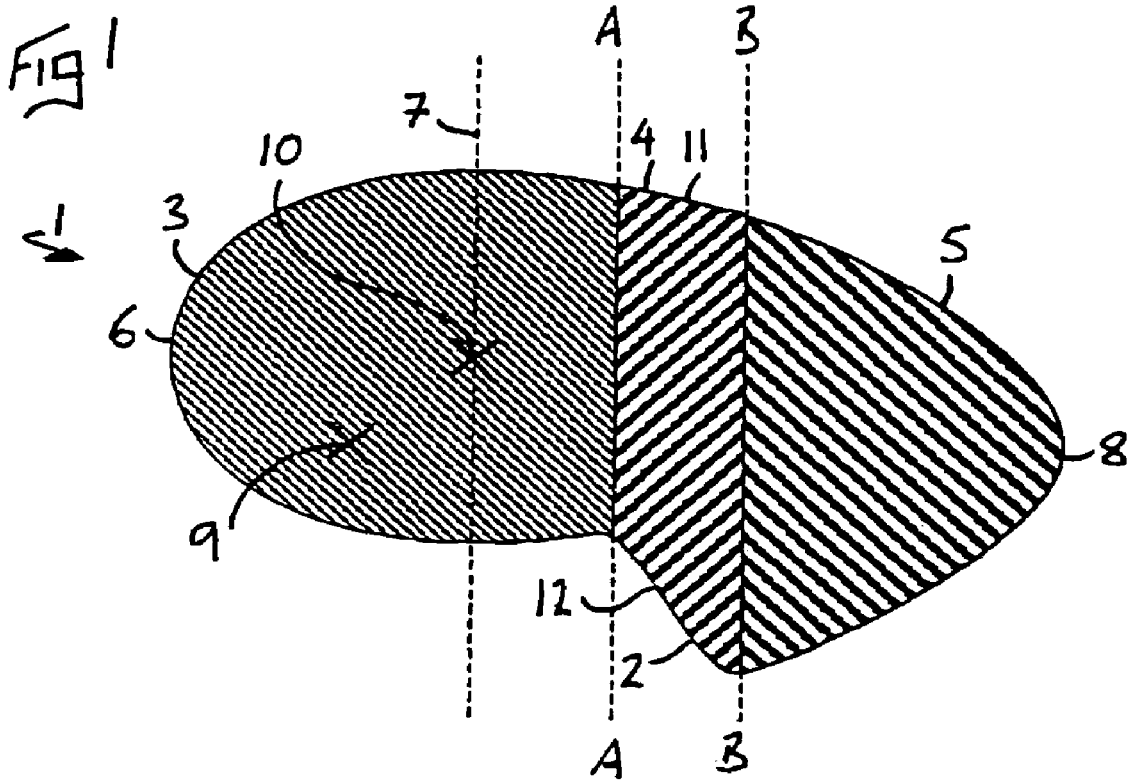

A
B
7
4
11
10
3
1
5
6
8
9
12
2
A
B

ROWING OR SCULLING OAR HANDLE

This invention relates to a rowing or sculling oar handle, for use particularly but not exclusively in the sport of rowing.

In rowing each participant uses one oar, and operates it with both hands. In sculling, the competitor uses two oars, or "sculls", one in each hand.

In both disciplines the oars are feathered between strokes. At the end of the stroke the user rotates the oar or oars through about 90 degrees such that the blades are parallel with the water, and just prior to the beginning of the stroke the oar or oars are rotated back so the blades can enter the water vertically.

Rowing and sculling oar handles are commonly made of wood, which is provided with a roughened surface to aid grip In the wet conditions. The action of rotating the oar or oars to feather the blades is therefore very tough on the hands and often leads to blisters and other injuries.

In addition, rowing and sculling oar handles are generally cylindrical in shape. When a competitor grips the handles for the stroke the flesh of their hands is compressed in an unnatural way around the cylindrical handle. This does not cause any problems for one or two strokes, but a rower may perform hundreds of strokes a session. The user grips the rough wooden surface with considerable force as all the power provided by their legs, torso and arms in pulling the stroke is transmitted through their grip on the handle. This unnatural, repetitive and high force grip is the primary cause of blisters and other skin injuries to rowers' and scullers' hands.

The present invention is intended to overcome some of the above problems.

Therefore, the present invention provides a rowing or sculling oar handle in which when the handle is orientated for a stroke it has an axial cross-sectional shape with a greater horizontal extent than vertical extent, and in which an underside of the axial cross-sectional shape is provided with an abutment.

In a preferred embodiment the axial cross-sectional shape can comprise a first portion proximal to the user in an in use position, a central portion, and a second portion distal to the user in an in use position. The first portion can be substantially shaped as more than half an oval and the second portion can be substantially shaped as less than half an oval. A centre of the oval shape of which the second portion forms a part can be vertically lower than a centre of the oval shape of which the first portion forms a part An upper surface of the central portion can follow a smooth line of curvature from the first portion to the second portion, and a lower surface of the central portion can follow a substantially straight line from the first portion to the second portion.

Therefore the abutment described above is provided by the lower surface of the central portion. The purpose of the abutment is to provide a surface against which a user's thumb can contact in use. Clearly, different users will have different sized hands, and therefore the handle can be dimensioned for a particular age group, or user's hands. Thus, in a preferred embodiment the handle can be dimensioned such that when a users hand grips the handle in the conventional way, their thumb can contact the abutment.

The purpose of the particular axial cross-sectional shape of the invention is to alleviate the damaging compression of the flesh of the hands caused when a traditional cylindrical handle is used. The cross-sectional shape is generally oval shaped, but the two ends of the oval, the first and second portions, are vertically misaligned. This provides a shape which when gripped hard and pulled causes far less compression of the flesh of the hands than a simple circular shape.

The handle can taper towards its outer end in the known manner, and the handle can be produced from wood. It can also be produced from any other suitable known material.

The handle can be formed as an integral part of an oar, or it can be a removable handle which can be attached and removed from an oar in the known way.

The invention can be performed in various ways but one embodiment will now be described by way of example, and with reference to the accompanying drawing in which FIG. 1 is an axial cross-sectional view of a rowing oar handle.

As shown in FIG. 1 a rowing or sculling oar handle, in the form of rowing oar handle 1, is provided. When the handle 1 is orientated for a stroke it has an axial cross-sectional shape with a greater horizontal extent than vertical extent, and an underside of said axial cross-sectional shape is provided with an abutment 2.

Referring to FIG. 1, the axial cross-sectional shape comprises a first portion 3 proximal to the user (not shown), a central portion 4, and a second portion 5 distal to the user. The three sections 3, 4 and 5 are shown in different cross-hatching, and are demarked by lines A and B for ease of understanding The first portion 3 is substantially shaped as more than half an oval. In other words it expands from an end point 6 to an axis 7 where it has its greatest height, then begins to taper towards an opposite end point.

The second portion 5 is substantially shaped as less than half an oval. In other words it expands from an end point 8 and does not reach a middle axis. The oval of which the second portion 5 forms a part is a larger and flatter oval than the oval of which the first portion 3 forms a part. As a result the second portion 5 is more pointed than the first portion 3, which is generally more round.

A centre 9 of the oval of which the second portion 5 forms a part is vertically lower than a centre 10 of the oval of which the first portion 3 forms a part.

An upper surface 11 of the central portion 4 follows a smooth line of curvature from the first portion 3 to the second portion 5. A lower surface 12 of the central portion 4 follows a substantially straight line from the first portion 3 to the second portion 5.

The rowing oar handle 1 is orientated for a stroke, which is to say that the blade of an oar (not shown) of which the handle is a part is substantially vertical and orientated for a stroke to be pulled. Thus in the position shown the user's hands would be arranged with their thumbs on the underside of the first portion 3, and potentially in contact with the abutmnent 2, and their fingers over the tops of the first portion 3, the central portion 4 and wrapped around the second portion 5.

When the oar (not shown) is to be feathered in use the handle 1 is rotated through substantially 90 degrees from the position shown in FIG. 1.

The handle 1 is made from wood, and tapers towards its outer end.

The embodiment described above can be altered without departing from the scope of the invention. For example, in an alternative embodiment (not shown) a handle like that shown in FIG. 1 can be used on both handles of a pair of sculls, as opposed to a rowing oar.

In another alternative embodiment, (not shown) the handle can be provided with an axial cross-section which is a simple oval, with an abutment on the underside.

Thus, a rowing or sculling oar handle is provided which reduces the harmful effects of rowing on the hands due to its more sympathetic axial cross-sectional shape.

The invention claimed is:

1. A rowing or sculling oar handle in which when the handle is orientated for a stroke it has an axial cross-sectional shape with a greater horizontal extent than vertical extent, and in which the axial cross-sectional shape comprises a first portion proximal to the user in an in use position, a central portion, and a second portion distal to the user in an in use position, in which the first portion is substantially shaped as more than half an oval, in which the second portion is substantially shaped as less than half an oval, in which a center of the oval of which the second portion forms a part is vertically lower than a centre of the oval of which the first portion forms a part, and in which an underside of the axial cross-sectional shape is provided with an abutment.

2. A rowing or sculling oar handle as claimed in claim 1 in which an upper surface of the central portion follows a smooth line of curvature from the first portion to the second portion, and in which a lower surface of the central portion follows a substantially straight line from the first portion to the second portion.

3. The rowing or sculling oar handle as claimed in claim 1 in which the handle tapers towards an outer end.

4. The rowing or sculling oar handle as claimed in claim 1 in which the handle is made from wood.

5. The rowing or sculling oar handle as claimed in claim 1 in which the handle is formed as an integral part of an oar.

6. The rowing or sculling oar handle as claimed in claim 1 in which the handle is formed as a removable handle which is attachable and removable from an oar with which it is used.

7. A rowing or sculling oar handle comprising a cross-sectional shape with a greater horizontal extent than vertical extent, and in which the axial cross-sectional shape comprises a first portion proximal to the user in an in use position, a central portion, and a second portion distal to the user in an in use position, in which the first portion is substantially shaped as more than half an oval, in which the second portion is substantially shaped as less than half an oval, in which a center of the oval of which the second portion forms a part is vertically lower than a centre of the oval of which the first portion forms a part, and in which an underside of the axial cross-sectional shape is provided with an abutment.

8. The rowing or sculling oar handle as in claim 7 in which an upper surface of the central portion follows a smooth line of curvature from the first portion to the second portion, and in which a lower surface of the central portion follows a substantially straight line from the first portion to the second portion.

9. The rowing or sculling oar handle as in claim 7 in which the handle tapers towards an outer end.

10. The rowing or sculling oar handle as in claim 7 in which the handle is made from wood.

11. The rowing or sculling oar handle as in claim 7 in which the handle is formed as an integral part of an oar.

12. The rowing or sculling oar handle as in claim 7 in which the handle is formed as a removable handle which is attachable and removable from an oar with which it is used.

13. A rowing or sculling oar handle section in which when the handle section is orientated for a stroke of an associated rowing or sculling oar blade it has an axial cross-sectional shape with a greater horizontal extent than vertical extent, in which an underside of the axial cross-sectional shape is provided with an abutment, and in which the handle section is axially fixed in relation to the associated rowing or sculling oar blade wherein the axial cross-sectional shape comprises a first portion proximal to the user in an in use position, a central portion, and a second portion distal to the user in an in use position, in which the first portion is substantially shaped as more than half an oval, in which the second portion is substantially shaped as less than half an oval, in which a center of the oval of which the second portion forms a part is vertically lower than a centre of the oval of which the first portion forms a part, in which an upper surface of the central portion follows a smooth line of curvature from the first portion to the second portion, and in which a lower surface of the central portion follows a substantially straight line from the first portion to the second portion.

14. The rowing or sculling oar handle section as in claim 13 in which the handle section is made from wood.

15. The rowing or sculling oar handle section as in claim 13 in which the handle section is formed as an integral part of an oar.

16. The rowing or sculling oar handle section as in claim 13 in which the handle section is formed as a removable handle which is attachable and removable from an oar with which it is used.

* * * * *